United States Patent [19]

Martin

[11] Patent Number: 5,012,616

[45] Date of Patent: May 7, 1991

[54] STORM DOOR OF TUBULAR FRAME CONSTRUCTION

[76] Inventor: William D. Martin, 5880 S. Jordan Canal Rd., Taylorsville, Utah 84118

[21] Appl. No.: 516,061

[22] Filed: Apr. 16, 1990

[51] Int. Cl.[5] ..... E06B 3/00

[52] U.S. Cl. ..... 49/501; 49/171; 52/455; 160/91

[58] Field of Search ..... 49/501, 67, 171; 160/90, 91, 92; 52/455, 456, 475, 476

[56] References Cited

U.S. PATENT DOCUMENTS

| | | | |
|---|---|---|---|
| 1,094,025 | 4/1914 | Scott | 52/455 X |
| 2,336,999 | 12/1943 | Peelle | 52/455 X |
| 3,024,837 | 3/1962 | McPhall | 160/91 |
| 3,374,822 | 3/1968 | Youssi et al. | 160/91 |
| 3,861,444 | 1/1975 | Portwood | 49/501 X |
| 3,895,669 | 7/1975 | Heeling | 49/171 X |
| 4,311,183 | 1/1982 | Herbst et al. | 49/501 X |
| 4,850,144 | 7/1989 | Grisham et al. | 49/501 X |

*Primary Examiner*—Philip C. Kannan

*Attorney, Agent, or Firm*—Thorpe, North & Western

[57] ABSTRACT

A storm door comprising a frame assembly which includes tubular metal frame members, each of the frame members having a uniform rectangular cross-sectional shape and being formed into a continuous unibody frame. The frame being rectangular in shape and including at least one opening therein. The storm door also including window and/or kick plate assemblies which include a flange member which allows the assembly to be easily inserted into the opening in the frame and attached thereto.

7 Claims, 4 Drawing Sheets

STORM DOOR OF TUBULAR FRAME CONSTRUCTION

BACKGROUND OF THE INVENTION

1. Field of the Invention

The present invention relates to an improvement in storm doors; more particularly, this invention relates to improvements in the structure and construction of storm doors.

2. Background of the Invention

To the present, aluminum has been a very basic material used in manufacturing doors especially storm doors which generally include a combination of aluminum framed screen and storm windows. The advantages of using aluminum have been that aluminum does not rust, and is relatively lightweight and maintenance free. However, aluminum if exposed to inclement weather conditions will become oxidized and therefore unsightly in appearance. Further, aluminum has become very expensive in recent years thus making quality doors fabricated from aluminum extremely expensive and less desired by the consumer. Also, even quality storm doors made of aluminum material generally tend to be significantly less durable than storm doors made of stronger materials.

There has existed a problem in the prior art of providing a storm door formed of material which is relatively inexpensive, yet which provides greater strength and durability than storm doors made of aluminum. Prior art attempts to manufacture a strong and durable storm door, which also can include recessed windows therein, have met with limited success.

For example, U. S. Pat. No. 2,336,999 to Peelle describes a storm door of tubular metal frame construction, the frame being formed from a sheet of metal, such as steel, which is bent into a tubular shape with flanges being formed of the interior edges of the sheet. The flanges are sealed together such as by welding, and the tubular members are formed into a frame for the storm door. With the flanges directed inward toward the opening formed by the frame, a window or kick panel can be inserted into and abutted against the flanges in the opening. The flanges becoming alignment members for the window to abut against to insure its correct placement in the opening.

This type of tubular member is generally referred to as a "roll form," and is very expensive to manufacture due to the tooling and dye costs associated with forming the tubular member from a flat piece of material. Further, since the framing member is of a unique shape, it is not a common stock item for steel suppliers and must be special ordered which also increases cost.

Similarly, U. S. Pat. No. 1,094,025 discloses a storm door with a recessed window in which the frame members thereof are formed of strips of sheet metal which are bent to a rectangular cross section. The strips are bent to form flanges which hold the glass panel or kick panel in the frame.

U. S. Pat. No. 3,024,837 to McPhail discloses a storm door having frame members formed of extruded aluminum which include reinforcement elements therein which support and secure the frame in its desired shape. The frame member includes a flange which extends into an interior open area of the frame, and which again functions to hold a panel of glass or the like in the framed-in opening.

In each of the above-referenced prior art storm doors, the framing members used to form the door must be roll formed or extruded into a unique shape required for the storm door construction. Further, because of the nature of the construction method used in forming the framing members, the framing members do not form a door of high rigidity, strength, and durability.

SUMMARY OF THE INVENTION

It is an object of the present invention to provide a storm door which is economical to manufacture yet has high strength and rigidity, and which is of an appealing design.

It is another object of the present invention to provide a method for manufacturing a storm door which allows for simple construction of a rigid and relatively secure frame into which a kick plate and/or window assembly can be quickly and easily fitted in a recessed manner.

It is another object of the present invention to provide a storm door which includes a steel frame which forms openings into which accessories such as aluminum framed windows and/or kick plates may be quickly and easily inserted and attached.

It is another object of the present invention to provide a storm door which is significantly more durable and has a significantly longer useful life than storm doors of the prior art.

These and other objects of the present invention are apparent in a preferred embodiment which includes a tubular frame assembly formed of hollow steel tubing having a rectangular cross section which is cut to the desired sizes to form individual elements of the frame, each individual element being cleaned with phosphoric acid or a phosphate coating and then being welded into a generally rectangular shaped frame, the frame forming an opening which may be segmented if desired into a plurality of rectangular openings by further framing elements, the framing elements being welded together and the welded joints being ground and smoothed to a desired finish, the frame then being treated with a phosphate which is applied thereto as an adhesion and rust inhibitor, the frame then being coated with powdered polyurethane and electrically charged to cause the powder to adhere to the metal, the powder then being baked at a high temperature and melted to the substrate, a glass panel and/or kick panel is then assembled in an aluminum frame having marine-type glazing thereon, and the preframed glass or kick panel is then placed in the rectangular shaped opening or openings of the frame, the frame then being a conventional handle mechanism installed thereon. After the components of the door have been fully assembled, the door may be prehung in a casing and attached thereto by hinges so as to simplify on-site installation if desired.

These and other objects, advantages and features of the invention will become apparent from the following description of the preferred embodiment, considered along with the accompanying drawings in which like numerals represent similar elements in each drawing.

DETAILED DESCRIPTION OF THE INVENTION

Figures 1, 2:
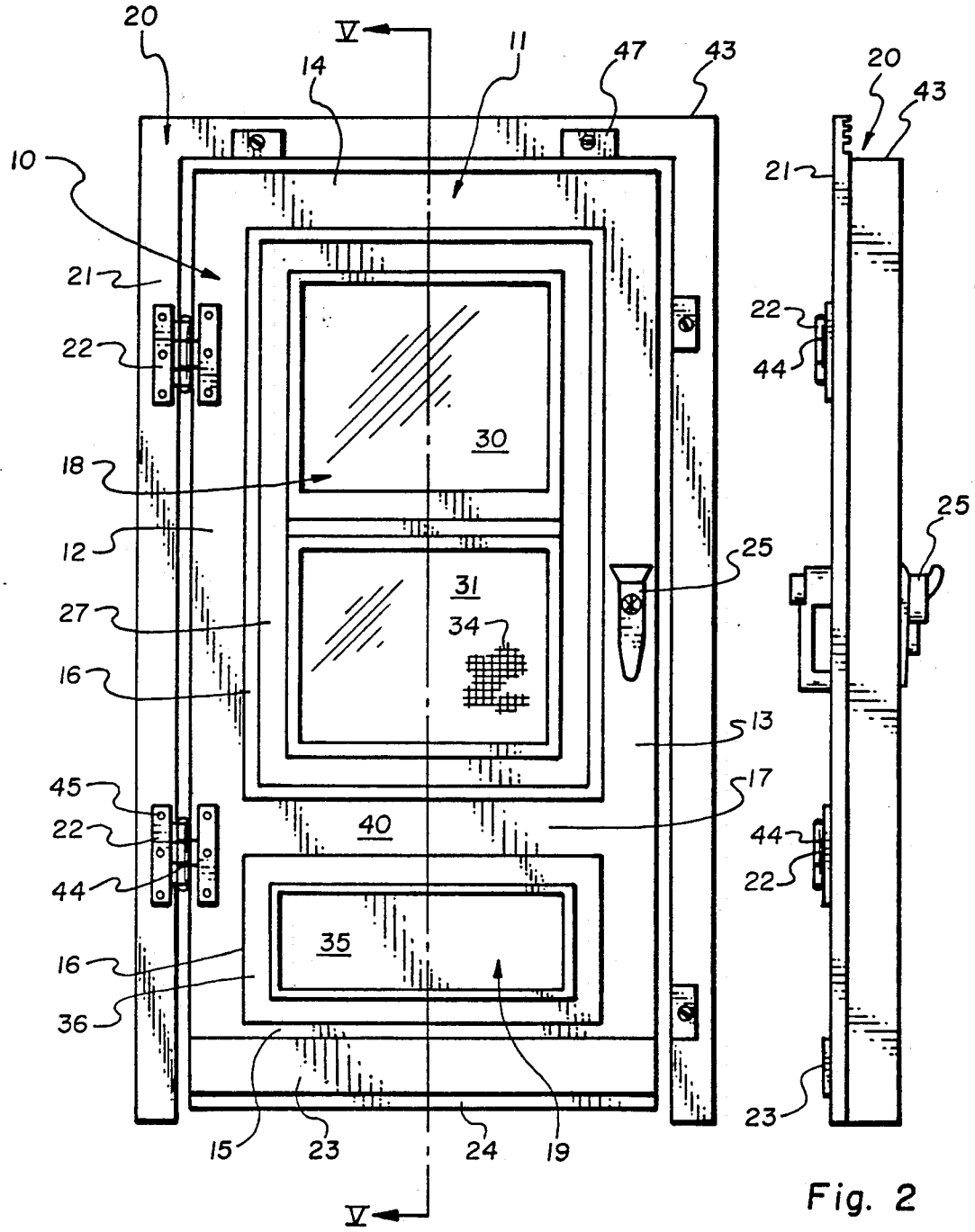
FIG. 1 is a front view of a storm door made in accordance with the principles of the present invention.
FIG. 2 is a side view of a storm door made in accordance with the principles of the present invention.

In FIG. 1, the storm door 10 of the present invention is shown as it would appear just prior to its insertion in a door 10 opening. The door 10 is formed from a frame assembly 11 of tubular steel members welded into a rectangular shape. The frame members 12, 13, 14 and 15 forming a rectangularly-shaped central opening 16 in the frame assembly 11 which will be filled by an insertion assembly in a manner to be explained below. The opening 16 may be divided by an intermediate frame member 17 into a plurality of rectangularly-shaped openings if desired. Each rectangularly-shaped opening 16 being sized to allow insertion of an insertion assembly such as window assembly 18 or a kick plate assembly 19.

The preferred embodiment of the present invention is formed with a large upper opening 16 into which is inserted a self-storing type window and screen assembly 18, and a lower rectangular shaped opening 16 into which is inserted a kick panel assembly 19.

The door 10 of the present invention may be prehung in a casing assembly 20. The casing assembly 20 being sized to allow retrofit of the entire door 10 into a standard door 10 opening. The door 10 is prehung to the facing 21 of the casing assembly 20 by hinges 22.

The door 10 may also include a bottom expander 23 and rubber weather stripping 24 which allows the bottom portion of the door 10 to be sized to match the threshold of the door 10 opening into which it is to be placed.

As can be seen in FIG. 2, the door 10 also includes an interior and exterior door 10 handle assembly 25. The handle assembly 25 is attached to the frame assembly 11 opposite the hinges 22. It is contemplated that any well-known type door 10 handle, including the internal locking mechanism therefor, be utilized on the door 10 of the present invention. Security devices, such as dead bolt locks or the like, are also contemplated to be used in conjunction with the door 10 of the present invention.

Figure 3:
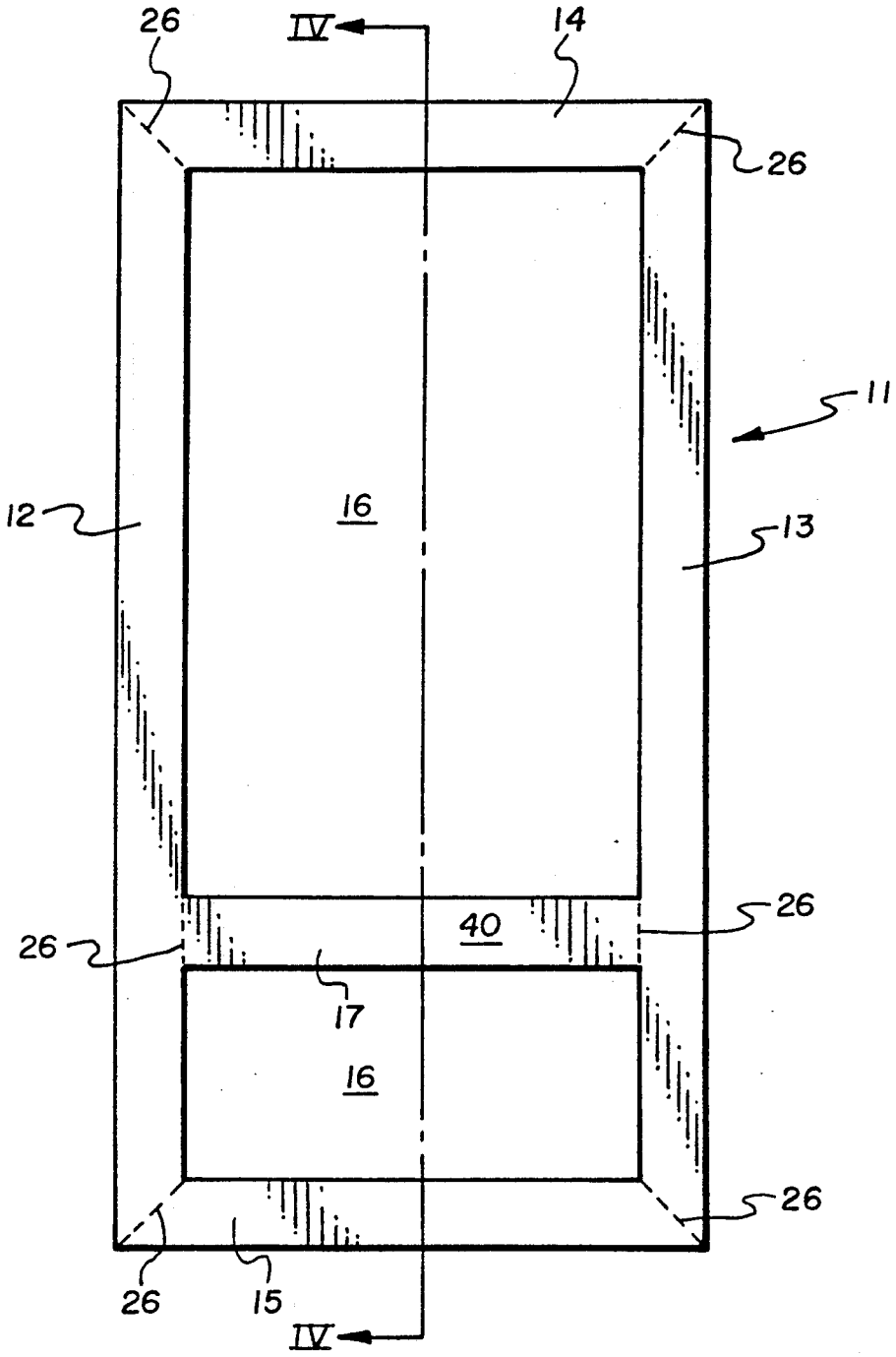
FIG. 3 is a front view of the frame assembly portion of the storm door made in accordance with the principles of the present invention.

As shown in FIG. 3, the frame assembly 11 is generally rectangular in shape with a pair of side members 12 and 13 which extend vertically along each longitudinal side of the door 10, and top and bottom members 14 and 15 respectively which connect with the ends of the side members to complete the rectangular shape of the frame assembly 11. If desired, an intermediate member 17 may be included as part of the frame assembly 11. The intermediate member 17 extending from one side member 12 to the opposite side member 13 in a horizontal orientation. The intermediate member 17 thus strengthening the overall frame assembly 11 and dividing opening 16 into a pair of rectangular openings.

The members 12, 13, 14 15 and 17 of the frame assembly 11, once formed into a unitary structure, define the rectangular shaped opening(s) 16 on the interior thereof. If an intermediate member 17, or a plurality of intermediate members 17 are also included in the frame assembly 11, the rectangular shaped opening 16 is thus divided into a plurality of rectangular shaped openings 16. The openings 16 formed by the frame assembly are sized to allow simple insertion of window or kick plate assemblies 18 and 19 respectively as will be explained below.

Figure 4:
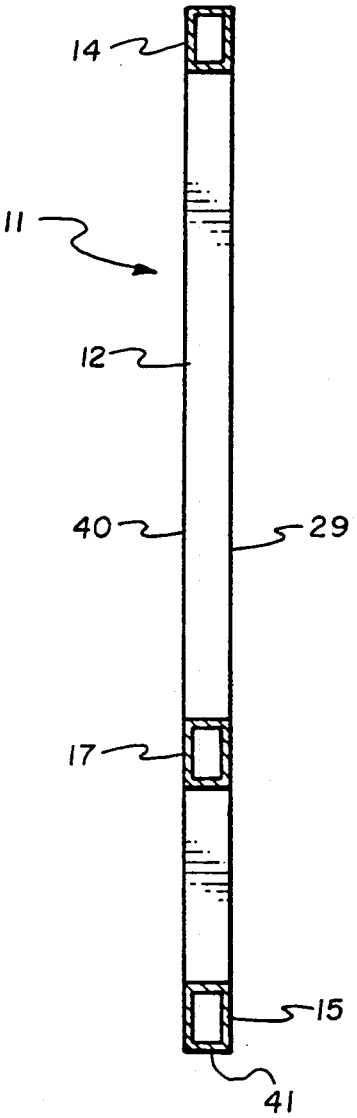
FIG. 4 is a cross-sectional view taken along IV—IV of FIG. 3.

Each member of the frame assembly 11 is formed of a hollow tubular steel having a generally rectangular cross section. As best shown in FIGS. 3 and 4, for simplicity and efficiency in design and expense, it is contemplated that each member 12, 13, 14, 15 and 17 of the frame assembly 11 be formed of identical stock. Meaning, each frame member is preferably formed of the same dimensioned tubular steel, i.e., each having the same cross-sectional dimensions. However, it is contemplated to be within the scope of the present invention that individual members of the frame assembly have different cross-sectional dimensions if needed or desired, in order to form the door 10 and/or the rectangular shaped interior openings 16 of the frame assembly 11 to desired size specifications.

The preferred tubular steel material is 16 gauge rectangular tubular cold-rolled steel. The preferred width of the cold-rolled steel is approximately two to three inches with the thickness being approximately one to two inches. Any other type of steel, however, may also be used such as mild, paint-lock, galvanized, etc. Other metals and/or combinations of metals may also be used depending upon the specific intended uses of the finished door.

The frame assembly 11 is formed by welding the joints 26 to form a continuous unibody structure. The joints 26 being formed at 45 degree angles with the side and top and bottom members 12, 13, 14 and 15, so as to cause the hollow tubular interior to be completely enclosed within the completed frame assembly 11.

The welding may be of any conventional welding technique, but is preferably done by a wire feed welder so as to eliminate excessive weld which must later be ground away in the finishing process.

The frame assembly 11 is the basis for the remainder of the construction of the door 10, and therefore supplies the major strength and rigidity thereof. If desired, for added rigidity, an intermediate member 17 may be welded horizontally across the opening 16 to the side members 12 and 13. It is contemplated, although not shown in the preferred embodiment, that any number of intermediate members 17 be formed as part of the frame assembly 11. These intermediate members obviously may extend across the opening 16 at any desired angle.

The frame assembly 11 is finished by first applying a phosphate treatment for adhesion and rust inhibition to its entire exterior surface. The prepared surface is then coated with powdered polyurethane and given an electronic charge to cause the powdered polyurethane to adhere to the metal in a thin, even coat. The frame is then baked at a high temperature to melt the polyurethane material. This causes the material to become a permanent thin coating over the entire exterior surface of frame assembly 11 which is very durable and which protects the steel from rust and other effects of weather.

Figure 5:
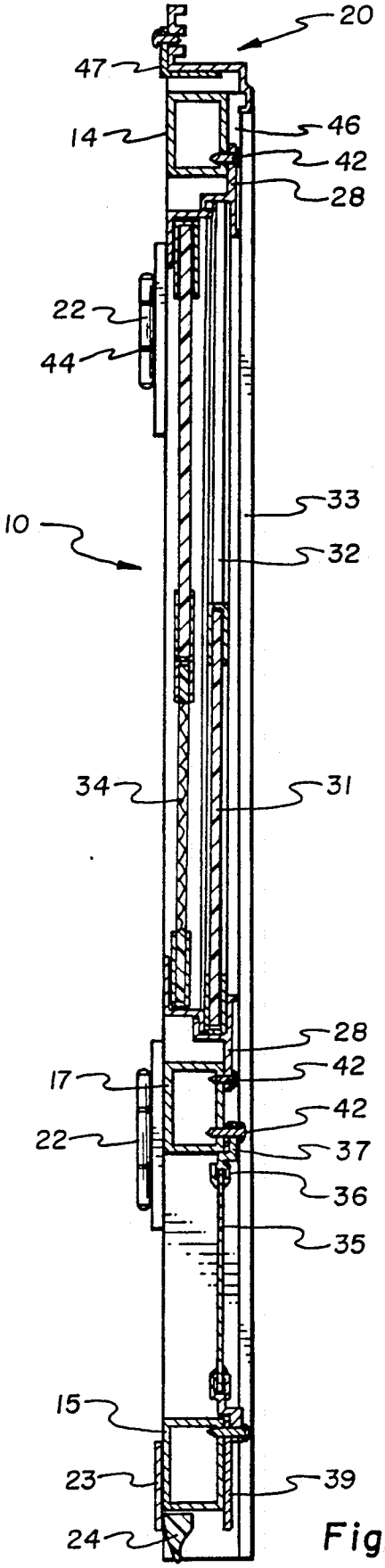
FIG. 5 is a cross-sectional view of the storm door of the present invention taken along line V—V of FIG. 1.

Referring now to FIG. 5, the window assembly 18 and the kick plate assembly 19 are shown in cross section. The window assembly 18 includes a window frame 27 which forms a flange 28 extending around the entire perimeter thereof. The flange 28 is of a size to allow the window frame 27 to be inserted into an opening 16 formed by the frame assembly 11 so that the flange 28 rests on the back surface 29 of the frame assembly 11 along the entire perimeter of the opening 16. The flange 28 is then screwed or otherwise secured to the back surface 29 of frame assembly 11 to hold the window assembly 18 in place in the opening 16. The window frame 27 is preferably formed of aluminum with marine wrapped aluminum glazing to securely hold a window or a plurality of windows therein.

For example, as shown in FIG. 5, the window assembly 18 includes a fixed window 30 and a slidable window 31. The slidable window 31 sliding in a window track 32 located on the interior surface 33 of the window frame 27. Further, a screen 34 may be included and held in place by the window frame 27.

The windows, screens and interior workings of the window assembly 18 are shown only as examples. It is contemplated that any combination of windows and/or screens, inserted in the window frame in any well-known manner, be used in conjunction with the present invention. The important and novel feature of the window assembly 18 of the present invention being the flange 28 on the perimeter surface of the window frame 27 which contacts the back surface 29 of the frame assembly 11, and secures the window assembly in a recessed position in the openings 16.

FIG. 5 also shows a kick plate assembly 19 which includes a kick plate 35 held in place by a kick plate frame 36. Again, the frame 36 includes a flange 37 which extends around the entire perimeter surface thereof, and which is sized to allow the kick plate frame 36 to be inserted into an opening 16 formed by the frame assembly 11, while the flange 37 rests on the back surface 29 of the frame assembly 11 around the entire perimeter of the opening 16. The flange 37 then being fastened as by screws or other well-known fastening devices to remain securely in place in the opening 16 in the frame assembly 11.

Again, it is contemplated that any design of kick plate and frame therefore be used as part of the present invention. The novel and inventive aspect of the kick plate assembly 19 being the flange 37 which allows ease of insertion of the kick plate assembly 19 into an opening 16 formed by the frame assembly 11, and which allows ease of attachment of the flange 37 to the back surface 29 of the frame assembly 11. The kick plate frame may also be formed of aluminum and may include a weather strip 38 located on the interior surface of the flange 37 so as to be located between the flange 37 and the frame assembly back surface 29 when the kick plate assembly 19 is attached thereto. The weather stripping 38 preventing air from passing from the front side of the kick plate assembly 19 to the back side thereof around the flanged area.

Figure 6:
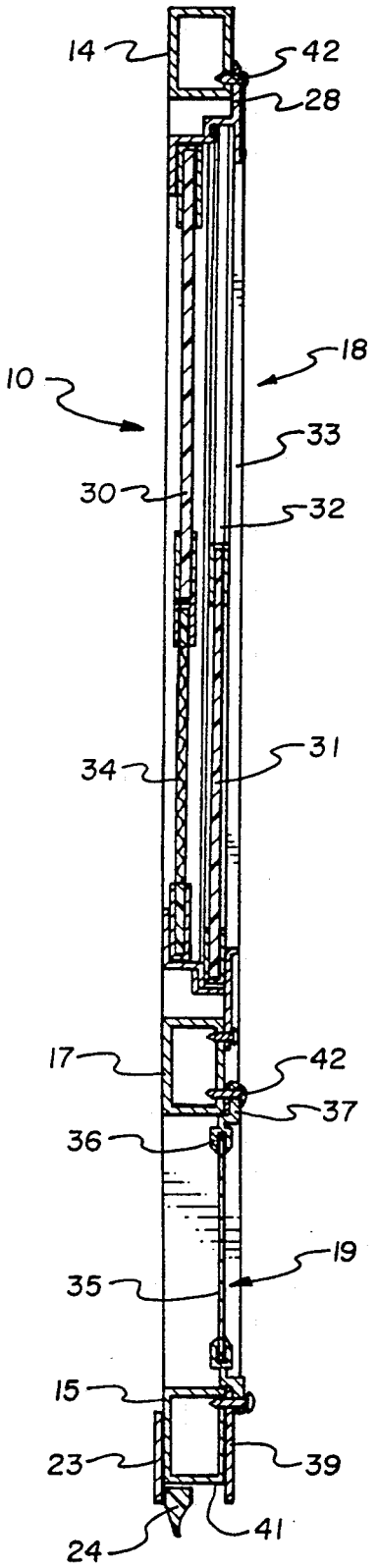
FIG. 6 is a cross-sectional view of the storm door as shown in FIG. 5 except that the casing portion thereof is removed.
Figure 7:
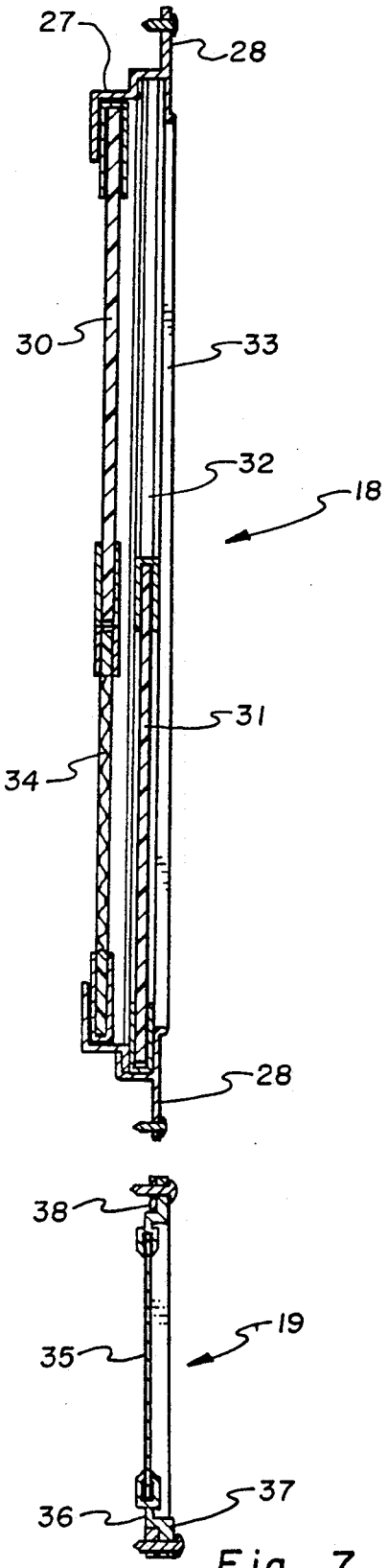
FIG. 7 is a cross-sectional view of the window and kick plate assembly portions of the storm door as shown in FIG. 6.

As can be seen in FIG. 6, the frame assembly 11 and the window assembly 18 and kick plate assembly 19, once attached together, substantially complete the construction of the storm door 10. It should be noted that the completed storm door 10 includes no screws or other attachment devices which are accessible from the front side of the door 10. This is so that the door 10, once assembled and placed in a door 10 opening, provides no means of disassembly thereof from the front surface. As is readily obvious, the door 10 once assembled and mounted in a door 10 opening, and locked, provides no access for anyone on the exterior thereof to disassemble any portion of the door 10.

To adjust the total length of the door 10 to fit a particular door 10 opening into which it is to be inserted, the bottom member 15 of the frame assembly 11 may have attached thereto bottom expanders 23 and 39. The bottom expanders 23 and 39 are merely long, thin metal plates which can be attached to the front and back surfaces 40 and 29 respectively of the bottom frame member 15 and extend below the bottom of the bottom frame member to extend the length of the door 10 a desired distance.

Also, the bottom surface 41 of the bottom member 15 of the frame assembly 11 may have attached thereto a weather stripping 24 which extends along the entire length of the bottom surface 41 of the door 10. The weather stripping 24 intending to extend below the bottom extenders 39 so as to contact the threshold of the door opening to prevent air from passing from the front side of the door 10 to the back side of the door 10 when the door 10 is closed. The weather stripping 24 may be made of rubber or any similar material commonly used for such purposes.

As best seen in FIGS. 1 and 2, the storm door 10 of the present invention may also include a casing assembly 20 into which the door 10 may be mounted, such as is commonly done in prehung door 10. The casing assembly 20 includes a U-shaped casing 43 which extends around the top and sides of the door 10. The casing 43 is sized so as to allow its insertion into a standard size door 10 opening and includes a facing surface 21 which is flush with the front surface 40 of the frame assembly.

The facing surface 21 and the front surface 40 of the frame assembly are attached together by a pair of hinges 22 located along side member 12 in a well-known manner. The hinges may be formed of steel having brass bushings 44 therein to accept the load of the door 10. Further, the hinges 22 may be attached to the facing surface 21 and the front surface 40 of the frame assembly by screws 45, rivets, or other well-known devices. It being preferred that any screws 45 or similar devices used to attach the hinges 22 be made of a type which allow the attachment of the hinge but prevent their detachment. Such attachment devices are commonly known to those of ordinary skill in the art.

With the hinges 22 attached so as to prevent any future detachment thereof, the entire door 10 including the casing assembly 20 is manufactured with no screws or other disassemblable construction attachment devices being present on the front of the door 10.

The casing assembly 20 may also include weather stripping 46 which is intended to contact the rear surface 29 of the door 10 around the perimeter of the frame assembly 11 so as to prevent passage of air from the front to the back of the door 10 when the door 10 is closed and in complete contact with the weather stripping 46 on the casing 43. The weather stripping 46 being held in its correct position on the casing 43 in a well-known manner.

The method of manufacturing the storm door 10 of the present invention is as follows. First, steel tubing of uniform cross-sectional dimensions is formed and cut to the desired size to form the individual members of the frame assembly 11. The members 12, 13, 14, 15 and 17 are then welded together at joints 26 to form a single unibody frame assembly 11. The welds are then ground off to form a smooth finish appearance with the surfaces of the framing members adjacent thereto.

The door 10 is then treated with a phosphate for adhesion and rust inhibition and a powdered polyurethane is applied to the entire exterior surfaces of the frame assembly. The door 10 is then given an electrical charge so that the powder forms a thin, uniform coating over the entire exterior surface of the frame assembly 11, and the frame is then baked at a high temperature to cause the polyurethane powder to adhere to the surface of the frame assembly and form a protective coating thereon.

The window assembly 18 and/or kick panel assembly 19 is then inserted into the openings 16 formed by the frame assembly 11, so that the flanges 28 and 37 extending from the window and/or kick panel frames 27 and 36 respectively overlap the portion of the back surface 29 of the frame assembly 11 which constitutes the perimeter of the opening 16. The flanges 28 and 37 are placed so as to contact the back surface 29 of the frame assembly 11.

The window and/or kick panel assemblies 18 and/or 19, having been inserted into the frame assembly 11 so that the flanges 28 and 37 contact the back surface 29 of the frame assembly 11, are then secured together by insertion of the screws 42 through the flanges 28 and 37 into the back surface 29 of the frame assembly 11. Thus, no screws or other attachment means are accessible from the front surface 40 of the door 10.

The bottom member 15 of the frame assembly 11 may then have attached to the front and back surface 40 and 29 thereof a pair of elongated flat metal plates 23 which extend the bottom of the door 10 a desired distance so that the door 10 will be of the proper dimensions for a door 10 opening into which it is to be placed. A weather stripping 24 may then also be attached to the bottom surface 41 of the bottom member 15 of the frame assembly 11 so as to be able to contact the threshold of the door 10 opening to prevent the passage of air from the front to the back of the door 10 when the door 10 is closed.

If desired, the completed door 10 may be prehung in a casing assembly 20 to allow ease of installation of the door 10 into a standard door 10 opening. The door 10 is attached to the casing assembly by hinges 22 which are screwed to the front facing surface 21 of the casing assembly 20 and the front surface 40 of the frame assembly 11 by screws or other similar attachment devices. The screws or other attachment devices being of a design which allow their attachment yet prevent any future disassembly of the hinge.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

I claim:

1. A door comprising a frame assembly means including tubular metal frame members, said tubular metal frame members having a uniform rectangular cross-sectional shape, said frame members forming a rectangularly shaped frame of continuous unibody construction, said frame forming at least one opening therein, an insertion assembly means including a frame having a flange which extends around the entire perimeter of said insertion frame, said flange being attached to said frame assembly means around the entire perimeter of said at least one opening.

2. A door according to claim 1 wherein said frame includes a rear surface and a front surface, said flange on said insertion assembly means being attached to said rear surface of said frame.

3. A door according to claim 1 wherein said frame members are formed of steel, and said flange of said insertion assembly means is formed of aluminum.

4. A door according to claim 1 wherein said frame assembly means includes a bottom frame member having a front surface, a back surface and a bottom surface, and said door further includes at least one elongate rectangular shaped expander member attached to said bottom surface of said frame member.

5. A door according to Clam 4 including a pair of expander members, one expander member being attached to said front surface of said bottom frame member and the other expander member being attached to said back surface of said bottom frame member.

6. A door according to claim 4 further including weather stripping means attached to said bottom surface of said bottom frame member.

7. A door according to claim 1 further including a handle means, said handle means being attached to said frame assembly means.

* * * * *